US012281391B2

(12) United States Patent
Chong et al.

(10) Patent No.: US 12,281,391 B2
(45) Date of Patent: Apr. 22, 2025

(54) SURFACE CONDITIONER FOR ELECTROLESS DEPOSITION

(71) Applicant: NANYANG TECHNOLOGICAL UNIVERSITY, Singapore (SG)

(72) Inventors: Jian Rong Chong, Singapore (SG); Hirotaka Sato, Singapore (SG)

(73) Assignee: Nanyang Technological University, Singapore (SG)

( * ) Notice: Subject to any disclaimer, the term of this patent is extended or adjusted under 35 U.S.C. 154(b) by 0 days.

(21) Appl. No.: 18/043,692

(22) PCT Filed: Sep. 7, 2021

(86) PCT No.: PCT/SG2021/050538

§ 371 (c)(1),
(2) Date: Mar. 1, 2023

(87) PCT Pub. No.: WO2022/055426

PCT Pub. Date: Mar. 17, 2022

(65) Prior Publication Data

US 2023/0265563 A1 Aug. 24, 2023

(30) Foreign Application Priority Data

Sep. 8, 2020 (SG) ..... 10202008720P

(51) Int. Cl.
*C23C 18/00* (2006.01)
*C23C 18/18* (2006.01)

(52) U.S. Cl.
CPC ..... *C23C 18/1893* (2013.01)

(58) Field of Classification Search
CPC ..... C23C 18/1893
USPC ..... 106/1.11
See application file for complete search history.

(56) References Cited

U.S. PATENT DOCUMENTS

| | | | |
|---|---|---|---|
| 5,275,861 A | 1/1994 | Vaughn | |
| 8,828,131 B2 | 9/2014 | Yamamoto et al. | |
| 2005/0209117 A1 | 9/2005 | Friedrich et al. | |
| 2010/0155255 A1 | 6/2010 | Nagao et al. | |
| 2018/0073149 A1* | 3/2018 | Chan | C23C 18/2086 |

FOREIGN PATENT DOCUMENTS

| | | |
|---|---|---|
| DE | 3121015 A1 | 12/1982 |
| JP | 59-116363 A | 7/1984 |
| JP | 2006-249520 A | 9/2006 |
| JP | 2008171875 A | 7/2008 |
| JP | 2011058062 A | 3/2011 |
| JP | 2019140325 A | 8/2019 |
| JP | 6666529 B1 | 2/2020 |
| WO | WO 2012169074 A1 | 12/2012 |

* cited by examiner

*Primary Examiner* — James E McDonough
(74) *Attorney, Agent, or Firm* — Seed IP Law Group

(57) ABSTRACT

A composition which conditions a surface for electroless deposition of a metal is disclosed. The composition comprises a polymer surfactant comprising repeating units of a monomer, wherein each of the repeating units comprises a functional group; a metal ion; and water, wherein the functional group in each of the repeating units forms a complex with the metal ion. In a preferred embodiment, the functional group is amine, and the surfactant comprises polyethyleneimine and/or polyallylamine. The metal ion comprises cobalt, rhodium, palladium or silver. A method of forming the composition as well as a method of electroless deposition using the composition are also disclosed.

18 Claims, 3 Drawing Sheets

FIG. 4

| | $PdCl_2$ catalysation without surface conditioning | $PdCl_2$ catalysation with surface conditioning of the present disclosure | Palladium colloid catalysation method used by industry |
|---|---|---|---|
| Plating thickness (um) | Not Present | 0.5 – 3 | 0.5 – 3 |
| Concentration of Pd in catalyst (ppm) | 10 - 30 | 10 - 30 | 70 - 100 |
| Pd loading ($ng/cm^3$) | 50 | 50 - 100 | 2000 |
| Plating duration (s) | Not applicable | 60 | 60 - 600 |
| Adhesion (kgf/cm) | Not applicable | 0.8 | 0.83 |

SURFACE CONDITIONER FOR ELECTROLESS DEPOSITION

CROSS-REFERENCE TO RELATED APPLICATION

This application claims the benefit of priority of Singapore Patent Application No. 10202008720P, filed 8 Sep. 2020, the content of it being hereby incorporated by reference in its entirety for all purposes.

TECHNICAL FIELD

The present disclosure relates to a composition for conditioning a surface for electroless deposition of a metal thereon. The present disclosure also relates to a method of forming the composition and its uses.

BACKGROUND

Traditional methods of electroless deposition (e.g. electroless plating) of a metal onto a surface or substrate involves applying a catalyst on the surface or substrate before having the metal deposited thereon.

In a reported example, a palladium tin colloid is adsorbed on a substrate. The palladium tin colloid is used as the catalyst. The catalysed substrate is subsequently subject to concentrated sulfuric acid to form palladium thereon. Such use of colloids is susceptible to a drawback wherein the colloids tend to aggregate and form sediments.

The aggregated colloids catalyst gives rise to uneven coating of palladium on the substrate, and the catalyst sediments do not even coat on the substrate in turn resulting in poor coating yield. To address this, methods developed used more catalyst or increase plating duration. However, such methods become uneconomical or require longer processing time.

There is thus a need to provide for a solution that addresses one or more of the limitations mentioned above. The solution should at least provide for an improved electroless deposition of a metal on a surface or substrate.

SUMMARY

In a first aspect, there is provided for a composition which conditions a surface for electroless deposition of a metal, the composition includes:

- a polymer surfactant including repeating units of a monomer, wherein each of the repeating units includes a functional group;
- a metal ion; and
- water,
- wherein the functional group in each of the repeating units forms a complex with the metal ion.

In another aspect, there is provided for a method of forming the composition described in various embodiments of the first aspect, the method includes:

- forming a metal salt solution including a metal ion in water;
- forming a polymer surfactant solution including a polymer surfactant, wherein the polymer surfactant includes repeating units of a monomer, wherein each of the repeating units includes a functional group; and
- mixing the metal salt solution and the polymer surfactant solution to form the composition.

In another aspect, there is provided for a method of electroless deposition, the method includes:

- treating a surface with the composition described in various embodiments of the first aspect;
- contacting the surface with a catalyst metal salt solution to form a catalyst-treated surface;
- contacting the catalyst-treated surface with a reducing agent to form a metal-coated surface; and
- contacting the metal-coated surface with a plating bath for electroless deposition of a metal on the metal-coated surface.

BRIEF DESCRIPTION OF THE DRAWINGS

The drawings are not necessarily to scale, emphasis instead generally being placed upon illustrating the principles of the present disclosure. In the following description, various embodiments of the present disclosure are described with reference to the following drawings, in which:

FIG. 4 is a table that lists the expected results for important electroless metal deposition parameters.

DETAILED DESCRIPTION

Figure 1:
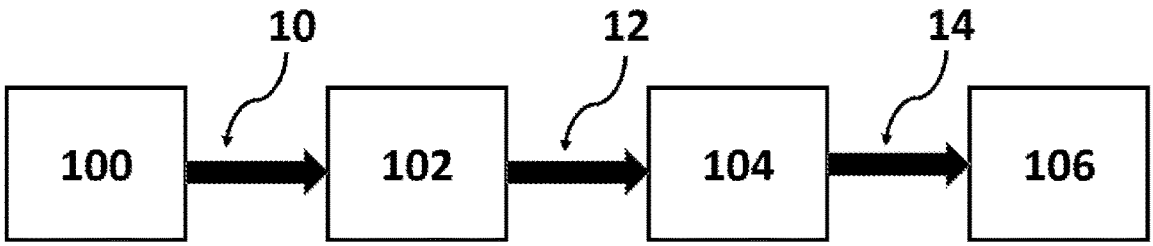
FIG. 1 shows a schematic diagram for electroless deposition of a metal onto a substrate using a surface conditioner of the present disclosure. In step 100, a polymeric substrate is submerged and treated with a heated (45° C.) surface conditioner under stirring agitation for 3 mins. The substrate is then rinsed with deionised water 10. After that, in the next step 102, the substrate is catalysed by dipping in a low concentration $PdCl_2$ ionic solution (10 ppm to 30 ppm) under room temperature (e.g. 20° C. to 40° C.) and agitation (e.g. stirring) for 5 mins. By dipping in such a catalyst solution, the surface of the substrate becomes primed with Pd catalyst ions. The substrate is then rinsed with deionised water 12. Next, in step 104, the Pd catalyst on the substrate is reduced by dipping in a reducing agent (e.g. 0.2 M $NaPO_2H_2$) under room temperature (e.g. 20° C. to 40° C.) in the absence of agitation for 1 min. The substrate is then rinsed with deionised water 14. After that, in step 106, the substrate is immersed into a plating bath formulated for electroless deposition of a desired metal to be plated thereon.
Figure 2:
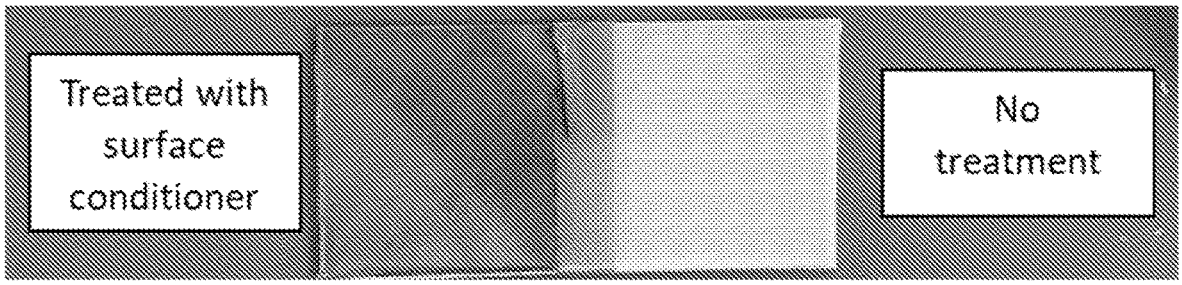
FIG. 2 shows a comparison of a substrate's surface treated (see left side of image) and not treated (see right side of image) with the surface conditioner of the present disclosure. When treated with the surface conditioner, the polymeric substrate is able to undergo successful electroless deposition. The non-treated surface experiences no electroless deposition even though it undergoes an identical catalysation procedure.
Figure 3:
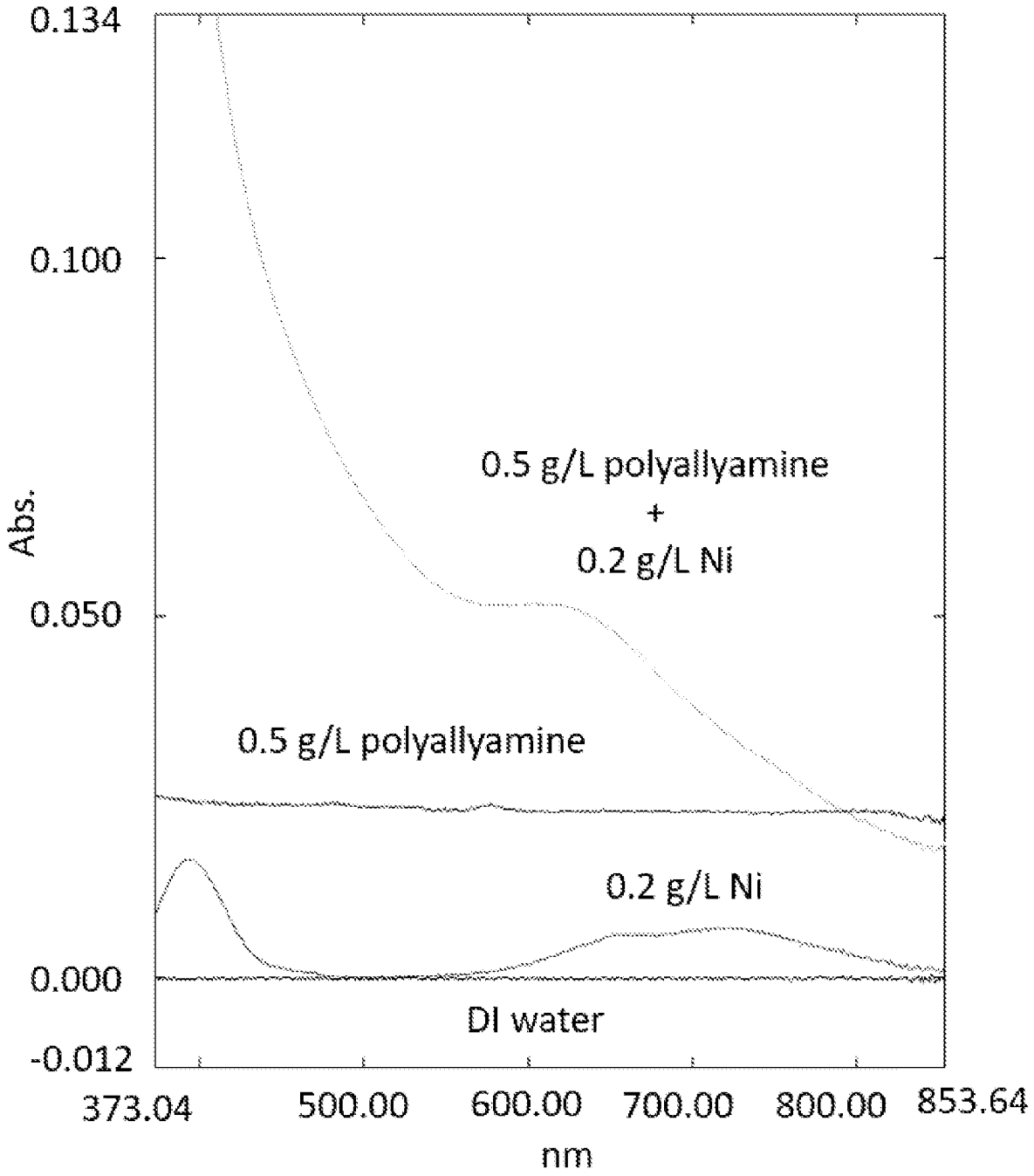
FIG. 3 shows a ultraviolet-visible (UV-vis) spectroscopy analysis of the complexation of nickel ions by polyallylamine. The formation of a new peak at 634 nm and elimination of the characteristic peaks of nickel ion at 660 nm and 730 nm is indicative of the complexation of nickel ions by the amine group surfactant.

The following detailed description refers to the accompanying drawings that show, by way of illustration, specific details and embodiments in which the present disclosure may be practised.

Features that are described in the context of an embodiment may correspondingly be applicable to the same or similar features in the other embodiments. Features that are described in the context of an embodiment may correspondingly be applicable to the other embodiments, even if not explicitly described in these other embodiments. Furthermore, additions and/or combinations and/or alternatives as described for a feature in the context of an embodiment may correspondingly be applicable to the same or similar feature in the other embodiments.

The present disclosure relates to a composition for conditioning a surface for electroless deposition of a metal thereon. The surface may be a surface of a substrate. Said differently, the composition can be used for electroless deposition of a metal on a substrate. The composition of the present disclosure may be termed herein a "surface conditioner", as the composition conditions a surface for electroless deposition of a metal thereon. The term "electroless deposition" and "electroless plating" herein are used interchangeably.

The present disclosure also relates to a method of forming the present composition and uses of the present composition. The uses of the present composition may include a method of electroless deposition using the present composition.

Details of various embodiments of the present composition, the method of forming the present composition, uses of the present composition, and advantages associated with the various embodiments are now described below.

In the present disclosure, there is provided a composition which conditions a surface for electroless deposition of a metal. The present composition may include a polymer surfactant. The polymer surfactant may include or may be formed of repeating units of a monomer. Each of the repeating units may include a functional group. In other words, the polymer surfactant may have a plurality of a functional group arising from the repeating units.

The plurality of functional groups present on the polymer surfactant may be same or different. For example, the polymer surfactant may have a plurality of one functional group and a plurality of another functional group. In instances where the polymer surfactant contains more than one type of functional group, the polymer surfactant may be a copolymer. The copolymer may be a random copolymer or a diblock copolymer. In various embodiments, the repeating units may be or may include the same functional group.

In various embodiments, the functional group may include an amine. In various embodiments, the polymer surfactant may include polyethyleneimine and/or polyallylamine. In various embodiments, the polymer surfactant may be present in a range of 0.1 wt % to 0.5 wt %, 0.2 wt % to 0.5 wt %, 0.3 wt % to 0.5 wt %, 0.4 wt % to 0.5 wt %, 0.1 wt % to 0.2 wt %, 0.1 wt % to 0.3 wt %, 0.1 wt % to 0.4 wt %, etc. Such ranges are advantageous for wetting the substrate, without being too viscous or render an excessive reduction in surface tension. If too little polymer surfactant is used (lower than such ranges), the wetting effect of the polymer surfactant and the enhancement of the catalytic activity conferred by the present composition are not achieved adequately. If too much is used, excessive bubbling of the conditioner and high viscosity may occur.

The present composition includes a metal ion. The functional group of the polymer surfactant may complex with the metal ion (e.g. a cation) through coordinate bonding. For example, where the functional group of the polymer surfactant includes an amine, the nitrogen in the amine may form the complex with the metallic cation. Further advantageously, the metal ion in the present composition allows for less PdCl catalyst solution subsequently used for the electroless plating (e.g. less Pd loading during electroless plating). For example, a PdCl catalyst solution subsequently used for electroless plating may have a lower concentration of Pd ions for electroless plating. In conventional electroless plating, a high PdCl concentration (i.e. high Pd loading) tends to be needed for electroless plating. Such traditional use of high concentrations can be avoided with the present composition and present methods. In various embodiments, the metal ion may include cobalt, rhodium, palladium, or silver. In various embodiments, the functional group in each of the repeating units, such as amine, interacts with the metal ion to form a complex with the metal ion. For example, the polymer surfactant may adhere to the surface of the substrate through reducing the surface tension of the substrate. Also, as most polymeric substrates undergoing electroless plating may have its surface etched, the surface of the substrate tends to have numerous cavities, high surface roughness, and free functional groups like —COOH and —OH. The surfactant may then adhere to the surface via (i) one or more types of bonding via the functional groups and (ii) physical adhesion or absorption.

In various embodiments, the metal ion may be present in a range of 0.01 wt % to 0.02 wt %, 0.01 wt % to 0.015 wt %, 0.015 wt % to 0.02 wt %, etc. The concentration of the metal ion used may correlate to the concentration of the polymer surfactant used. In other words, the amount of polymer surfactant used and the amount of metal ion used may depend on each other. If too little metal ion is used, the efficacy of the conditioner at enhancing the catalytic activity may be compromised. If too much metal ion is used, the excessive metal ions may not be complexed by the polymer surfactant, and may lead to metal hydroxide in the presence of an alkali base, which in turn may end up fouling the present composition. In various embodiments, the metal ion may be present in a range of 0.02 wt % to 0.02 wt %, albeit having the metal ions in the form of the metal ion-polymer surfactant complex.

As mentioned above, the present composition may further include an alkali metal base. The alkali metal base may be optional. The alkali metal base may be used to adjust the pH of the solution. In various embodiments, the alkali metal base may be or may include sodium hydroxide or potassium hydroxide. The alkali metal base may be present in a concentration of 0.1 M to 0.5 M, 0.2 M to 0.5 M, 0.3 M to 0.5 M, 0.4 M to 0.5 M, 0.1 M to 0.2 M, 0.1 M to 0.3 M, 0.1 M to 0.4 M, etc.

The present composition include water. Water serves as the solvent compatible for the polymer surfactant and metal ions to be dissolved therein. Said differently, the present composition is an aqueous composition.

The present disclosure includes a method of forming the composition described in various embodiments of the first aspect mentioned above. Embodiments and advantages described for the present composition of the first aspect can be analogously valid for the present method of forming the present composition subsequently described herein, and vice versa. As the various embodiments and advantages have already been described above and in examples demonstrated herein, they shall not be iterated for brevity.

The present method of forming the present composition includes forming a metal salt solution comprising a metal ion in water, forming a polymer surfactant solution comprising a polymer surfactant, wherein the polymer surfactant comprises repeating units of a monomer, wherein each of the repeating units comprises a functional group, and mixing the metal salt solution and the polymer surfactant solution to form a mixture. The mixture may constitute the present composition.

In various embodiments, forming the metal salt solution may include dissolving a metal salt in water. The metal salt solution dissolved in water renders the metal ion of the present composition. As a non-limiting example, where the metal to be plated on a surface or substrate is palladium, the metal salt solution and hence the metal ion may be a palladium (II) chloride ($PdCl_2$) solution and palladium (Pd) ions, respectively. Other metal salt solution may be used depending on the metal to be plated.

In various embodiments, forming the metal salt solution may include dissolving the metal salt in water to have the metal ion present in a concentration of 0.02 wt % to 0.2 wt %, 0.02 wt % to 0.04 wt %, 0.02 wt % to 0.03 wt %, 0.03 wt % to 0.04 wt %, etc.

In various embodiments, forming the polymer surfactant solution may include dissolving the polymer surfactant in water. Forming the polymer surfactant solution may include dissolving the polymer surfactant in water to have the polymer surfactant present in a concentration of 0.2 wt % to 1.0 wt %, 0.3 wt % to 1.0 wt %, 0.4 wt % to 1.0 wt %, 0.5 wt % to 1.0 wt %, 0.6 wt % to 1.0 wt %, 0.7 wt % to 1.0 wt %, 0.8 wt % to 1.0 wt %, 0.9 wt % to 1.0 wt %, etc. Various embodiments of the polymer surfactant have been described above and hence shall not be reiterated for brevity.

In the present method, mixing the metal salt solution and the polymer surfactant solution may include mixing the metal salt solution and the polymer surfactant solution in equal volume.

The present method may further include dissolving an alkali metal base in a mixture formed when mixing the metal salt solution and the polymer surfactant solution. Dissolving the alkali metal base in the mixture may be optional. In the present method, dissolving the alkali metal base in the mixture may include dissolving the alkali metal base to have a concentration of 0.1 M to 0.5 M, 0.2 M to 0.5 M, 0.3 M to 0.5 M, 0.4 M to 0.5 M, 0.1 M to 0.2 M, 0.1 M to 0.3 M, 0.1 M to 0.4 M, etc.

The present disclosure further includes a method of electroless deposition. The present method includes use of the present composition described in various embodiments of the first aspect mentioned above. Embodiments and advantages described for the present composition of the first aspect and the present method of forming the present composition can be analogously valid for the present method of electroless deposition subsequently described herein, and vice versa. As the various embodiments and advantages have already been described above and examples demonstrated herein, they shall not be iterated for brevity.

The present method of electroless deposition may include treating a surface with the composition described in various embodiments of the first aspect mentioned above, contacting the surface with a catalyst metal salt solution to form a catalyst-treated surface, contacting the catalyst-treated surface with a reducing agent to form a metal-coated surface, and contacting the metal-coated surface with a plating bath for electroless deposition of a metal on the metal-coated surface.

In the present method of electroless deposition, treating the surface with the composition includes heating the composition and stirring the composition in the presence of the surface. As a non-limiting example, the surface or substrate may be immersed into the present composition that is already heated. Advantageously, this helps speed up the electroless deposition (i.e. improve kinetics of the coating reaction for the metal to be plated thereon) as well as improve the uniformity of the metal plated thereon. In various embodiments, heating the composition may include heating the composition to a temperature in a range of 40° C. to 60° C., 45° C. to 60° C., 50° C. to 60° C., 55° C. to 60° C., 40° C. to 55° C., 40° C. to 50° C., 40° C. to 45° C., etc. If the temperature is lower, duration of the surfacing conditioning step or more surface conditioner may need to be used, potentially damaging the substrate and/or undesirably modifying the surface properties of the substrate. If the temperature is too high, excessive evaporation of water from the solution may occur and the metal-complex concentration may be altered. In certain non-limiting embodiments, the surface or substrate may be immersed in the present composition that is already heated to 45° C.

In various embodiments, the reducing agent may be or may include $NaPO_2H_2$. Other reducing agent suitable for reducing the metal catalyst into a metal on the surface may be used.

In various embodiments, the catalyst metal salt solution may include a catalyst metal salt present in a concentration of 10 ppm to 30 ppm, 20 ppm to 30 ppm, 10 ppm to 20 ppm, etc. If the concentration is higher, there may be more loss of catalyst during the subsequent washing procedures as the high concentrations of Pd gets washed off. This then incurs additional costs to recover Pd from the wastewater. If the concentration is too low, the catalytic effect may be difficult to achieve. The catalyst metal salt may provide for a different metal ion from or same metal ion as the metal ion of the present composition. In other words, the catalyst metal salt used for electroless plating does not depend on the metal salt used for the present surface conditioner. The metal salt for preparing the surface conditioner may contain different or identical metal ion as the metal salt of the electroless plating bath.

In various embodiments, the present method of electroless deposition may further include washing the surface with water (e.g. deionised water) prior to contacting the surface with the catalyst metal salt solution. In various embodiments, the present method of electroless deposition may further include washing the catalyst-treated surface with water (e.g. deionised water) prior to contacting the catalyst-treated surface with the reducing agent. In various embodiments, the present method of electroless deposition may further include washing the metal-coated surface with water (e.g. deionised water) prior to contacting the metal-coated surface with the plating bath.

The word "substantially" does not exclude "completely" e.g. a composition which is "substantially free" from Y may be completely free from Y. Where necessary, the word "substantially" may be omitted from the definition of the present disclosure.

In the context of various embodiments, the articles "a", "an" and "the" as used with regard to a feature or element include a reference to one or more of the features or elements.

In the context of various embodiments, the term "about" or "approximately" as applied to a numeric value encompasses the exact value and a reasonable variance. The variance may be ±20%, ±10%, ±5%, ±1%, ±0.5%, ±0.1%, etc.

As used herein, the term "and/or" includes any and all combinations of one or more of the associated listed items.

Unless specified otherwise, the terms "comprising" and "comprise", and grammatical variants thereof, are intended to represent "open" or "inclusive" language such that they include recited elements but also permit inclusion of additional, unrecited elements.

EXAMPLES

The present disclosure relates to a surface conditioner for pre-treating a surface or substrate to enhance electroless metal deposition thereon, such as electroless nickel deposition and electroless copper deposition, while reducing catalyst loading traditionally necessary to achieve the deposition/plating. The surface or substrate may be non-metallic, non-conductive, and/or polymeric.

The surface conditioner may include a polymer surfactant made up of repeating units of a functional group (such as amine group) capable of forming a complex with a metal ion. For instance, the polymer surfactant may be dissolved in deionised water with a metal salt containing a targeted metal (i.e. desired metal) that is to be plated onto a surface or substrate. The substrate may be dipped into the solution (i.e. surface conditioner) containing the polymer surfactant, metal salt and water, followed by dipping the substrate into a catalyst metal salt solution having a sufficiently low concentration of the catalyst (e.g. a low palladium (Pd) catalyst ion solution such $PdCl_2$ solution). The polymer surfactant captures the metal salt, and the Pd ions (as an example in this case), to become attached over and on the substrate. The substrate is then dipped into a reducing agent solution (e.g. 0.2 M $NaPO_2H_2$) for the substrate to be covered with the reduced metal (e.g. Pd). The Pd works as a catalyst to induce electroless plating.

The present surface conditioner, method of forming the surface conditioner and a method of electroless deposition using the surface conditioner, are described in further details, by way of non-limiting examples, as set forth below.

Example 1: Materials

The components that make up the present surface conditioner include, but are not limited to, a polymer surfactant, a metal salt that provides a metal ion, a strong alkali metal base (optional), and deionised water.

The polymer surfactant can include repeating units of one or more functional groups, wherein each of the one or more functional groups can form a complex with the metal ion. A non-limiting example of the functional group may be an amine group.

The metal salt can contain a metal ion, wherein the metal ion is formable into a metal that is to be plated onto a surface or a substrate.

Example 2: Preparation of the Surface Conditioner

Preparation of the present surface conditioner is described as follows.

A metal salt containing a targeted metal (i.e. metal to be plated on a surface or substrate) is first dissolved in deionised water to form a metal salt solution. The metal salt solution can have a metal ion concentration in the range of 0.02% to 0.04% by weight (wt %).

A long-chain surfactant having one or more repeating functional groups (e.g. repeating units each having an amine group), such as polyethyleneimine, polyallylamine, etc., is selected and dissolved in deionised water to form a surfactant solution having a concentration in the range of 0.2 wt % to 1.0 wt %.

The surfactant solution is slowly added to the metal salt solution in equal volumes to form a mixture and until the desired volume of conditioner is achieved. Ultraviolet-visible (UV-vis) spectroscopy can be performed on the mixture to characterize and confirm the total complexation of all metal ions by the surfactant and that there is no trace of uncomplexed metal ions.

A strong alkali metal base (e.g. KOH) may be dissolved in the mixture to be present in a concentration in the range of 0.1 M to 0.5 M for forming the surface conditioner.

The final composition of the conditioner can be, for example, 0.1% to 0.5% surfactant by weight, 0.01% to 0.02% metal ion by weight, and 0.1 M to 0.5 M alkali metal base.

Example 3: Electroless Deposition Using Present Surface Conditioner

A polymeric surface or substrate (e.g. acrylonitrile butadiene styrene (ABS) plate) is submerged and treated with the heated (e.g. 45° C.) surface conditioner under stirring agitation for, as an example, 3 mins.

The treated substrate is then washed by rinsing in deionised water for 5 to 10 seconds. Then, the treated substrate is catalysed by dipping in a low concentration $PdCl_2$ ionic solution (10 ppm to 30 ppm) under room temperature (e.g. 20° C. to 40° C.) and agitation (e.g. stirring) for 5 mins. The low concentration $PdCl_2$ ionic solution is a non-limiting example of the catalyst metal salt solution. The catalyst metal salt solution differs from the metal salt solution used to prepare the surface conditioner. The metal salt solution for the surface conditioner has the metal ions complexed with the polymer surfactant. However, in the catalyst metal salt solution, the metal ions derived therefrom can exist as free metal ions, as the catalyst metal salt solution is absent of the polymer surfactant and the catalyst metal salt solution contains no additives. The use of $PdCl_2$ is not meant to be limiting but merely an example for demonstrating the present surface conditioner and its use in electroless deposition of a metal on a surface or substrate. Other ionic catalyst solutions for electroless plating containing metal ions, such as ions of silver (Ag), rhodium (Rh), cobalt (Co), etc. also worked.

The treated substrate is then washed by rinsing in deionised water for 5 to 10 seconds.

The treated substrate is then dipped in a reducing agent (e.g. 0.2 M $NaPO_2H_2$ or any other reducing agent suitable for electroless plating of a metal) under room temperature (e.g. 20° C. to 40° C.) with no agitation for 1 min to form a catalysed substrate having Pd metal.

The catalysed substrate having Pd metal is then washed by rinsing in deionised water for 5 to 10 seconds.

Finally, the catalysed substrate having Pd metal is immersed into a plating bath formulated for electroless deposition of the desired metal plating. A non-limiting example of a plating bath solution can be a nickel electroless plating bath containing 0.2 M sodium citrate, 0.5 M boric acid, 15 g/L nickel (II) sulphate hexahydrate and 37.5 g/L sodium hypophosphite monohydrate. Commercial nickel plating baths such as Uyemura 'Mekongka NEN' plating solution or Okuno 'Chemical Nickel EXC' plating solution may be available.

While the present disclosure has been particularly shown and described with reference to specific embodiments, it should be understood by those skilled in the art that various changes in form and detail may be made therein without departing from the spirit and scope of the present disclosure as defined by the appended claims. The scope of the present disclosure is thus indicated by the appended claims and all changes which come within the meaning and range of equivalency of the claims are therefore intended to be embraced.

The invention claimed is:

1. A composition which conditions a surface for electroless deposition of a metal, the composition comprising:

a polymer surfactant comprising repeating units of a monomer, wherein each of the repeating units comprises a functional group;

a metal ion; and water, wherein the functional group in each of the repeating units forms a complex with the metal ion, wherein the metal ion is present in the composition in a range of 0.01 wt % to 0.02 wt %, and wherein the polymer surfactant is present in the composition in a range of 0.1 wt % to 0.5 wt %.

2. The composition of claim 1, wherein the repeating units comprise the same functional group.

3. The composition of claim 1, wherein the functional group comprises an amine.

4. The composition of claim 1, wherein the polymer surfactant comprises polyethyleneimine and/or polyallylamine.

5. The composition of claim 1, wherein the metal ion comprises cobalt, rhodium, palladium, or silver.

6. The composition of claim 1, further comprising an alkali metal base.

7. The composition of claim 6, wherein the alkali metal base is present in a concentration of 0.1 M to 0.5 M.

8. A method of forming the composition of claim 1, the method comprising:

forming a metal salt solution comprising a metal ion in water;

forming a polymer surfactant solution comprising a polymer surfactant, wherein the polymer surfactant comprises repeating units of a monomer, wherein each of the repeating units comprises a functional group; and mixing the metal salt solution and the polymer surfactant solution to form the composition, wherein the metal ion is present in the composition in a range of 0.01 wt % to 0.02 wt %, and wherein the polymer surfactant is present in the composition in a range of 0.1 wt % to 0.5 wt %.

9. The method of claim 8, wherein forming the metal salt solution comprises dissolving a metal salt in water to have the metal ion present in a concentration of 0.02 wt % to 0.2 wt %.

10. The method of claim 8, wherein forming the polymer surfactant solution comprises dissolving the polymer surfactant in water to have the polymer surfactant present in a concentration of 0.2 wt % to 1.0 wt %.

11. The method of claim 8, wherein mixing the metal salt solution and the polymer surfactant solution comprises mixing the metal salt solution and the polymer surfactant solution in equal volume.

12. The method of claim 8, further comprising dissolving an alkali metal base in a mixture formed when mixing the metal salt solution and the polymer surfactant solution, wherein dissolving the alkali metal base in the mixture comprises dissolving the alkali metal base to have a concentration of 0.1 M to 0.5 M.

13. A method of electroless deposition, the method comprising:

treating a surface with the composition of claim 1;

contacting the surface with a catalyst metal salt solution to form a catalyst-treated surface;

contacting the catalyst-treated surface with a reducing agent to form a metal-coated surface; and contacting the metal-coated surface with a plating bath for electroless deposition of a metal on the metal-coated surface.

14. The method of claim 13, wherein treating the surface with the composition comprises:

heating the composition; and stirring the composition in the presence of the surface.

15. The method of claim 14, wherein heating the composition comprises heating the composition to a temperature in a range of 40° C. to 60° C.

16. The method of claim 13, wherein the reducing agent comprises $NaPO_2H_2$.

17. The method of claim 13, wherein the catalyst metal salt solution comprises a catalyst metal salt present in a concentration of 10 ppm to 30 ppm.

18. The method of claim 13, further comprising:

washing the surface with water prior to contacting the surface with the catalyst metal salt solution;

washing the catalyst-treated surface with water prior to contacting the catalyst-treated surface with the reducing agent; and washing the metal-coated surface with water prior to contacting the metal-coated surface with the plating bath.

* * * * *